US005220733A

United States Patent [19]

Bothe et al.

[11] Patent Number: 5,220,733

[45] Date of Patent: Jun. 22, 1993

[54] MODULAR RADIANT PLATE DRYING APPARATUS

[75] Inventors: Juergen Bothe, Sherwood Park; John Tansowny, Edmonton; Ed Wasyliw, Millet; Zbig Wolanksi, Edmonton; Steve Pisio, Edmonton; Jim Razzell, Edmonton; Alfred Ruefli, Sherwood Park, all of Canada

[73] Assignee: 21st Century Design Inc., Canada

[21] Appl. No.: 791,946

[22] Filed: Nov. 14, 1991

[51] Int. Cl.[5] ..... F26B 7/00

[52] U.S. Cl. ..... 34/17; 34/39; 34/180; 34/182

[58] Field of Search ..... 34/39, 40, 4, 1 W, 1, 34/179, 180, 181, 182, 183, 17

[56] References Cited

U.S. PATENT DOCUMENTS 4,176,465 12/1979 Murray et al. .
4,429,643 2/1984 Mulholland .

FOREIGN PATENT DOCUMENTS 1095232 2/1981 Canada .
1146813 5/1983 Canada .
1080930 4/1960 Fed. Rep. of Germany .
1922230 11/1969 Fed. Rep. of Germany .
1658136 12/1970 Fed. Rep. of Germany .
3544300 7/1987 Fed. Rep. of Germany .
1583837 12/1969 France .
1222033 2/1971 United Kingdom .
2050589 1/1981 United Kingdom .

OTHER PUBLICATIONS

PCT/CA90/00074, Filed Mar. 1, 1990 in the name of Gerhard Schmidt et al.

*Primary Examiner*—Henry A. Bennet

*Attorney, Agent, or Firm*—Marger, Johnson, McCollom & Stolowitz

[57] ABSTRACT

A universal industrial modular drying apparatus called a Radiant Plate Dryer for drying sewage sludge, pulp sludge, other industrial sludges, slurries, grains, cereals, organic and inorganic fibres and pulps, chemical waste and other similar materials. The apparatus includes: a dryer module which may be constructed for mobile or fixed installation applications; a constant flow material input system; a number of spiral auger flights in a jacketed open trough joined together to form an upper auger bed; a source of variable infrared energy for providing high intensity infrared flux to open troughs of the upper auger bed; a condenser to capture and condense volatiles released by the material during processing and to heat glycol for preheating material to be processed of for other heat exchange purposes; a number of spiral auger flights enclosed in jacketed tubes formed together to form two other radiant heat augers beds, the jackets being formed in each auger flight by an inner tube containing a spiral auger disposed inside an outer tube defining a jacket divided by flanges into an upper portion through which hot flue gas flows and a lower portion void of flue gas, the radiant heat provided by the inner tube upper portion having vanes extending radially into the jacket affecting heat transfer to the upper inner tube surface thereby focusing high intensity radiant heat in addition to convective heat upon the material enclosed; a hot flue gas distribution system to selectively circulate hot flue gases through a auger flight jackets; a flue gas water cooling system using water sourced from the condenser to provide finite process heat control in the auger flights and the dryer module, a condenser vent gas destruction system to consume noncondensable volatiles released during material processing; and a dried material storage system.

23 Claims, 10 Drawing Sheets

70
24
70
70
24
68
26
68
12
22
68
18
14

FIG. 2.
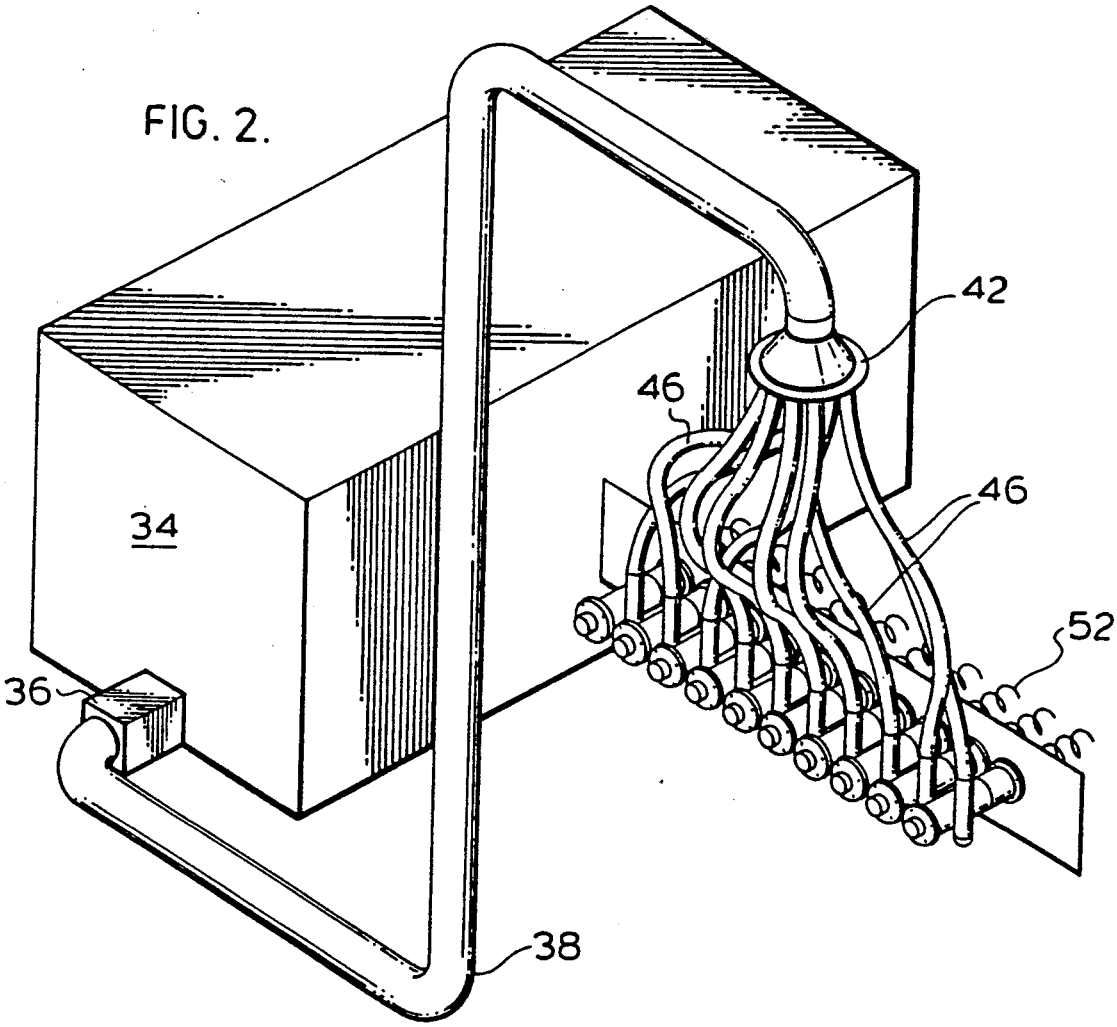
FIG. 3.
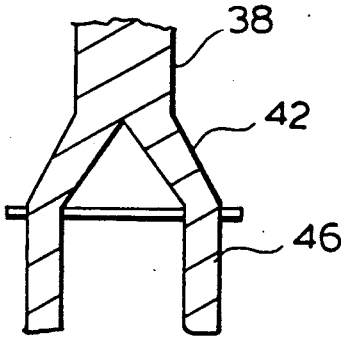
FIG. 4A.
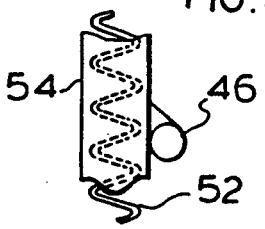
FIG. 4C.
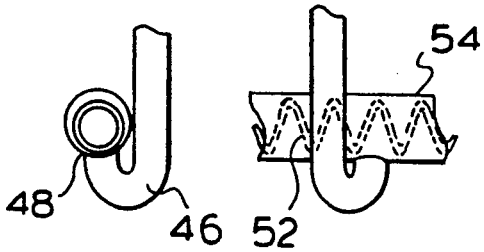
FIG. 4B.

MODULAR RADIANT PLATE DRYING APPARATUS

FIELD OF THE INVENTION

This invention relates to an apparatus and method for continuous drying of sewage sludge, pulp sludge, other industrial sludges, slurries, grains cereals, organic and inorganic fibres and pulps, chemical waste and other materials.

BACKGROUND OF THE INVENTION

Grain and cereal harvest are hampered internationally whenever damp fall weather prevents crops from naturally drying in the field. Threshing cannot be completed because there is no large scale viable mechanical process to satisfactorily and economically dry grains and cereals. As a result, yields and product quality seriously deteriorate while farmers wait for favourable sun and wind conditions to naturally dry the kernels. And, if these conditions to not occur, crops can be lost entirely.

Accordingly, there is a long-felt need for means to safely dry these grains and cereals in a temperature controlled environment in order to preserve their commercial value.

Industrial processing of a wide variety of materials produces fine waste by-products which must be disposed of. Many are slurries of fine organic or inorganic particles suspended in water, and are referred to in industry as "sludge". Others are fibrous or chemically contaminated natural and artificial materials of varying consistency. Rigid and increasingly stringent environmental standards and legislation very tightly control disposal of these waste products. Sources vary widely and include pulp and paper mills, sewage treatment plants, large dairy farms, potash mines, coal mines, oil sand plants, chemical plants, wineries, dry cleaning plants and many other processing operations.

A typical sludge or slurry consists of 20% to 30% organic and/or inorganic solids and the balance is water. Handling this material is difficult because of the high water content, but also because it frequently contains chemicals or heavy materials which are harmful to the environment, or biologically active components which are dangerous to humans.

In the past, in order to reduce handling and disposal costs, industry's focus has been on devising methods to concentrate these waste materials by reducing the water content. This is accomplished mechanically by using equipment like belt presses or centrifuges in the processing stream, (common in the pulp and paper industry) or by constructing expensive and large holding ponds (common in sewage treatment and mining operations) where the material is allowed over time to settle and naturally concentrate. These methods achieve a maximum concentration of about 40% solids, but do not remove the harmful chemicals and metals, or sterilize the active biological elements.

Recently, industry has been searching for more effective means to "dry" industrial waste and at the same time environmental agencies have introduced legislation forcing mechanical treatment and more secure handling and disposal of such waste. Several systems have been designed for this purpose. These systems use indirect heating methods and consist of kilns, furnaces, burners and a variety of continuous and batch feed ovens. Typically, the heat energy in these systems is transferred to the material being processed by blowing hot air across the material, or by directing the material over hot heating surfaces. In the process, large volumes of air must be used and this air becomes contaminated by contact with the waste product as a result of picking up small quantities of fine particles, as well as by capturing volatile gases released by the material as it dries. As a result, this "contaminated" air requires processing before being released into the atmosphere. Such systems tend to be large, expensive and not portable, and furthermore produce a dried end-product that has been burned and therefore is of limited use for recycling.

One recent solution to the drying of sewage sludge is found in PCT application number PCT/CA90/00074 of Schmidt et al, published Sep. 7, 1990. This application describes a proposed mobile method and apparatus for drying sewage sludge in which the sludge is conveyed on tiered helical conveyors through a heated chamber and is subjected to radiant heat. The radiant heat is indicated as being supplied by a plurality of identical burner chambers disposed side by side. Each of the burner chambers provides an equal amount of heat. Air is heated in the burners and blown through the hollow axles of the auger shafts and through holes in the shafts to mix with the sludge. As the sludge dries, it is described as releasing steam which is drawn off into a condenser where the water and hot vent gases are separated. The vent gases are recycled through the burner chambers, where harmful gases are broken down.

At the exit of the heated chamber, it is suggested sewage sludge will typically have been reduced to a maximum solids content of from 80% to 95%. The sewage sludge is input to the helical conveyors through an open supply funnel and a helical feeder conveyor.

This design has several problems. Firstly, there is no continuous supply mechanism. During normal operation, supply of sewage sludge to the helical conveyors can be disrupted and result in an irregular supply of sewage to the helical conveyors. Irregular supply could damage components of the dryer since the extreme heat produced by the burners would not be mitigated by the heat sink effect of the drying sewage sludge. Burning of the sludge as well as serious plugging could occur.

Also this prior art dryer has no apparent means to control heat distribution at machine start up, therefore subjecting all internal components to very damaging high heat stress which dramatically affects useful machine operating life.

Further, this prior art dryer does not distribute flue gases in a manner that would follow the heat transfer gradient, which declines along the drying path. That is, as sewage sludge travels through the machine water is gradually lost through evaporation which significantly reduces the sludge's ability to absorb heat, yet this design provides equal heat energy throughout the machine, making no provisions for the diminishing heat gradient.

Further, the helical conveyors described in this prior disclosure render it difficult to move sewage sludge along the conveyor, and the individual transfer chutes located at the end of each auger flight may be subject to plugging.

SUMMARY OF THE INVENTION

According to the present invention a universal dryer is provided which overcomes the above-described specific problems associated with processing sewage sludge, as well as providing a means to successfully and very effectively dry, but more importantly, recycle a wide variety of other materials by achieving precise drying temperature control. The drying system is housed in a dryer module that can be affixed to a trailer for portable operation, built into a new plant for a permanent installation or added to an existing plant to upgrade, improve or replace existing drying systems. The invention provides in its various aspects, a continuous controlled feed into an infrared radiant heat dryer module, with a back up reservoir of material to be processed. High intensity infrared flux is supplied by a radiant plate fire box with a number of radiant flame burners which permit zone heat control. Exhaust gases from the fire box are ducted into variable distribution ducts and supplied to jackets in layered horizontal auger banks, described in more detail below, and which transport the material being processed through the dryer module. A temperature control system is also provided using water cooling for reducing the temperature of the hot flue gases circulated through the auger flight jackets to allow precise temperature control in the dryer module to facilitate the processing of temperature sensitive materials like grains, cereals and recyclable organic fibres, pulps and materials. These, together with other features, will be described in more detail in the remainder of this patent disclosure.

According to an aspect of the invention there is provided:

a dryer module having an input end for receiving wet material containing solids and an output end for discharging dried solid materials;

one or more auger banks disposed within the dryer module between said input ends and said output end, each auger bank being made up of a number of auger flights, each flight including a rotatable spiral auger for continuously conveying said material within the auger flight;

a heat source for providing radiant heat to at least one of said one or more auger banks so as to heat and thereby dry said material, the heat source also providing a source of flue gases; and flue gas distribution means for providing flue gas from the heat source to at least one of said auger banks for further heating and thereby drying of said material.

The dryer includes water injection means having an outlet in the flue gas distribution means upstream of the auger banks. This water injection means serves to cool the flue gases and the volume of water injected may be controlled to control the flue gas temperature being supplied to the auger banks, therefore providing precise temperature control of the auger banks.

The auger flights are preferably distributed in layered banks inside the module. The flue gas distribution means is constructed to provide flue gas volume, and therefore temperature control differentially to the auger banks and their flights. The auger banks preferably include a first bank, a second bank and a third bank, and the flue gases are distributed differentially to the banks about 50% to the first bank, about 30% to the second bank and about 20% to the third bank.

Each auger flight in the lower bank preferably includes an outer tube, an inner tube disposed within the outer tube to form a jacket between them; a spiral auger disposed within the inner tube; the jacket having a separate upper portion and lower portion; the upper portion being in fluid connection with the hot gas distribution means so as to become a radiant as well as convective heat exchanger, and the lower portion being isolated from the hot flue gas distribution means.

According to another aspect of this invention there is provided a method of drying industrial sludges or industrial organic and inorganic slurries comprising:

storing a volume of wet material adjacent to a dryer module in a holding tank;

providing a continuous flow of material from the holding tank to auger flights disposed within the dryer module;

heating the material by a radiant heat source, the radiant heat surface being disposed across the length of the dryer module;

moving the material continuously through the dryer module;

drying the material to sufficient dryness to accommodate safe storage or disposal; and removing the dried material from the dryer module.

It is preferable during start up, to provide initially greater infrared flux to a first portion of the top auger bank than to a second portion and differentially supply hot flue gases to the jackets of the first and second levels of auger banks, with more heat going to the upper levels. Distribution of heat energy improves drying efficiency, therefore reducing fuel costs, but more importantly, minimizes the thermal stress and unnecessary temperature shock to key metal components which will occur when there is no material being processed to act as a heat sink to absorb the heat energy.

For grain drying or drying of other materials, and to prevent over heating or burning of heat sensitive materials, as well as to permit recycling, the method may also include selectively cooling the hot flue gases before distribution into the auger flight jackets so as to permit the finite temperature control of each auger bank, and therefore, finite temperature control of all of the drying process.

BRIEF DESCRIPTION OF THE DRAWINGS

There will now be described a preferred embodiment of the invention, with reference to the drawings, by way of illustration, in which like numerals denote like elements and in which:

FIG. 2 is a schematic of a delivery system for the radiant plate dryer module shown in FIGS. 1A and 1B;

FIG. 3 is a section through the conical distributor shown in FIG. 2;

FIGS. 4A, 4B and 4C are schematic sections of the radiant plate dryer module of FIGS. 1A and 1B;

DETAILED DESCRIPTION OF THE PREFERRED EMBODIMENT

The preferred embodiment described below concerns a system primarily in relation to a mobile configuration for industrial and sewage sludge processing, although the system has utility for fixed or mobile configurations to drying many other materials such as grain, cereals, chemical slurries, organic fibres, dairy waste, mine tailings and other similar waste products. And, because of its modular design, the system can be built into fixed installations like sewage treatment plants, pulp mills, coal mines, potash mines and industrial processing plants, either as an add-on to replace old and inefficient existing equipment, or as a component of the process operation for new facilities. In such installations, the dryer module of the present invention would form the base component and material input, material output, condensate cycling, exhaust gas cycling, and the control systems would be custom designed to meet specific needs to the plant's operation and make the most efficient use of heat exchange opportunities.

Figure 1A:
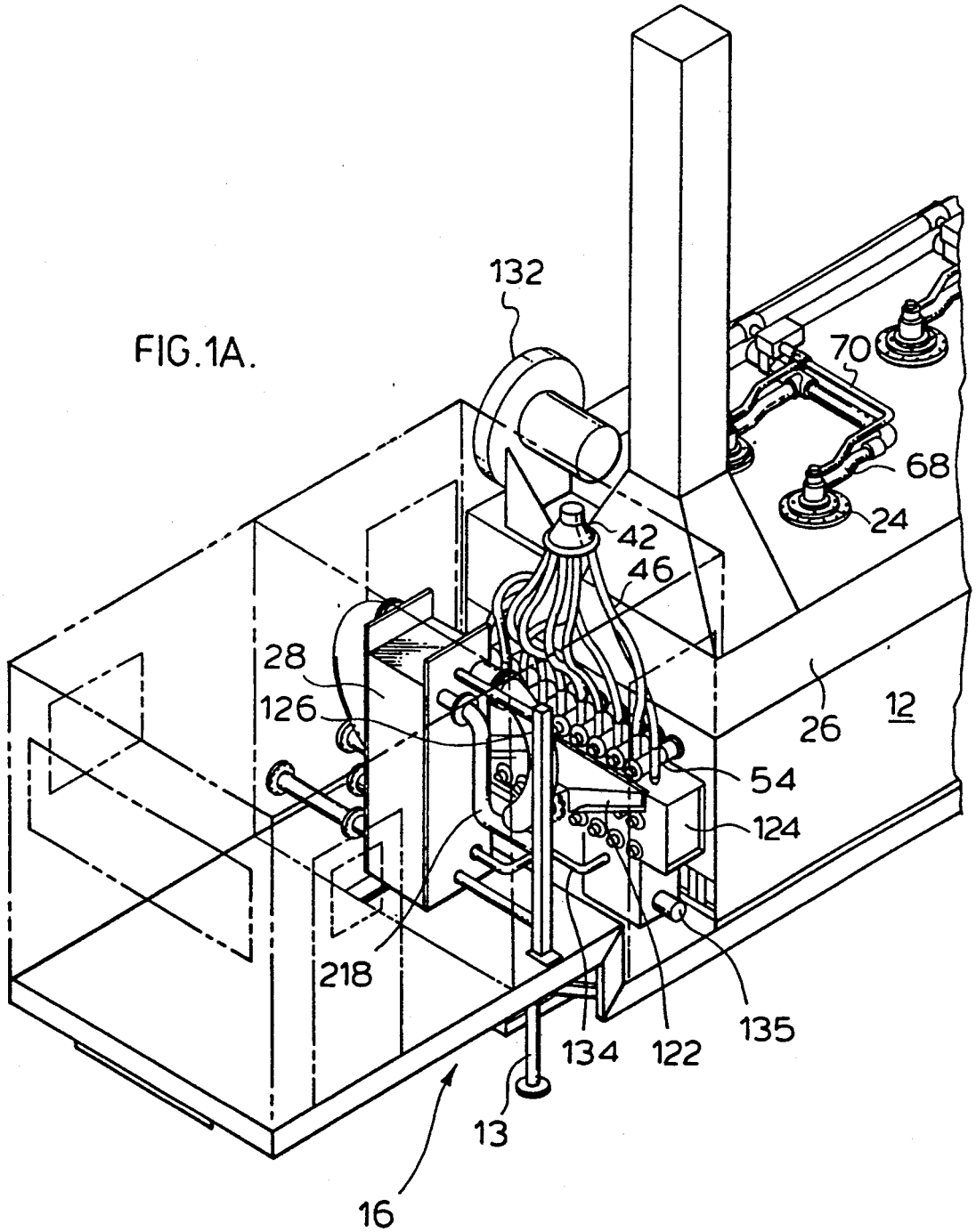
FIGS. 1A and 1B are together a perspective, partly broken away and partly in ghost outline of a radiant plate dryer module according to the invention.
Figure 1B:
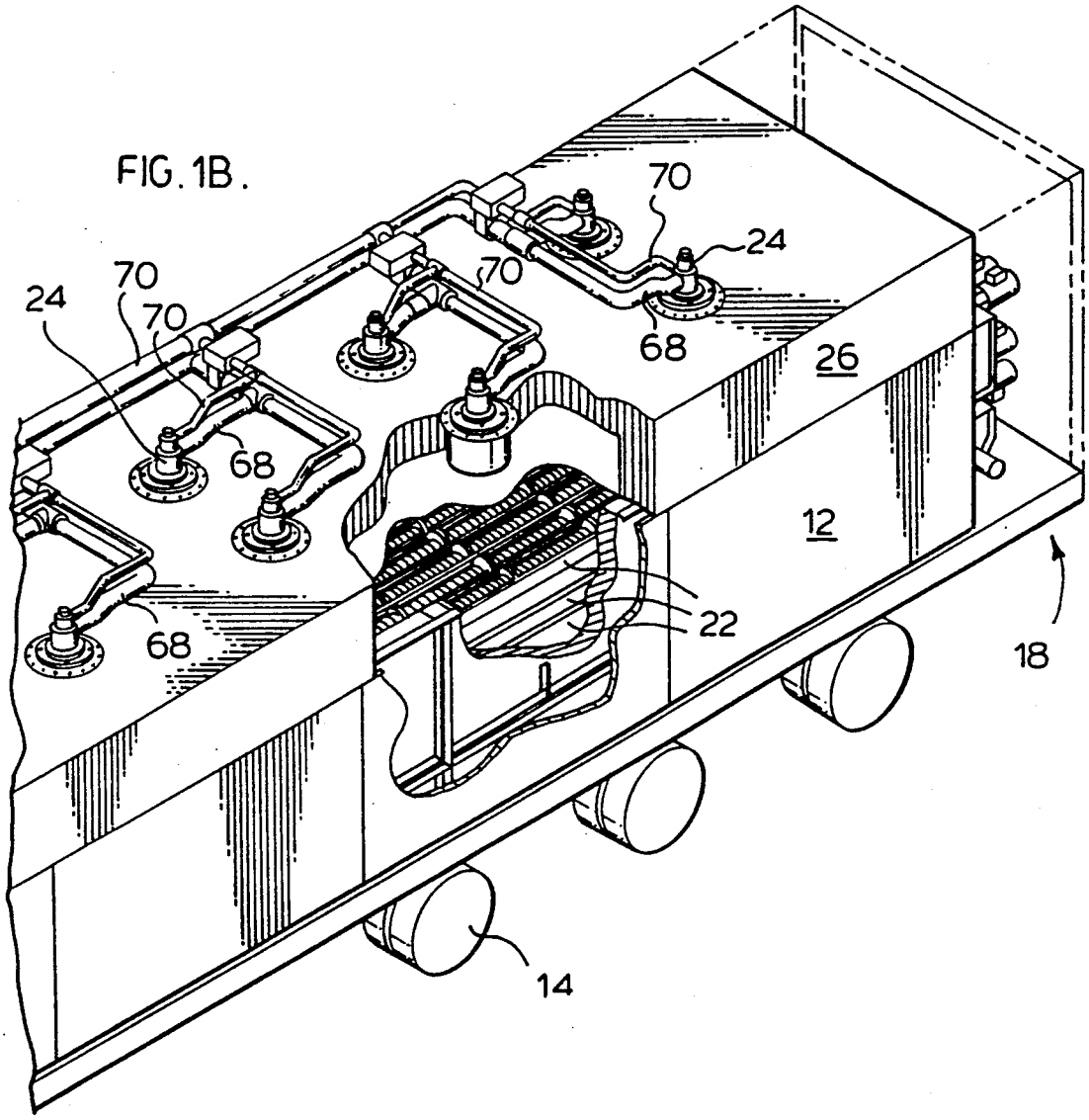

Referring firstly to FIGS. 1A and 1B, there is shown a dryer module 12 which encloses a drying chamber and which can easily be mounted on a trailer 14. The dryer module 12 has an input end 16 and an output end 18. Tiered auger banks 22 are shown in the cutaway view of module 12. A number of radial flame burners 24 are attached to the upper part of a heater module 26, to form a fire box heating means. Sludge enters the module at the input end 16 through the distribution system located there which is more particularly described below in relation to FIGS. 2, 3, 4A, 4B and 4C.

Also shown at the input end 16 is a condenser 28 which, together with its associated ducts, draws steam and waste gases from the module 12. Uncondensed vent gases from inside the module, discharged from the condenser 28, are recycled to the radial flame burners 24 and consumed in the fire box. Hot exhaust flue gases, which contain substantial useful energy are directed to the auger banks 22 through a flue gas distribution system shown as 32 schematically in FIG. 7. The water and gas condensation and circulation system will be described in more detail in relation to FIGS. 5A, 5B, 7 and 8. The construction of the auger banks 22 will be described in more detail in relation to FIG. 6.

Referring to FIGS. 1A, 1B, 2, 3, 4A, 4B, and 4C there will now be described the material input and distribution system. A wet product storage tank 34 for processing sludge or slurries preferably has from 60 to 120 $m^3$ storage capacity and is located close by the dryer. A skid mounted mud tank like those commonly used in oil well drilling may conveniently be used for mobile operations. For mobile use, the holding tank 34 would be fitted with plate-coils (not shown) built into the tank's side wall and bottom. These would be in fluid connection with the condenser 28 to preheat the material to be processed through lines (not shown) containing heated glycol running from the condenser 28 to the holding tank 34.

The holding tank 34 is fitted with one or preferably two progressive displacement cavity pumps 36. The progressive displacement cavity pumps are shown in schematic form only since they are preferably Moyno TM pumps made by Robbins and Myers and are readily available commercially. In addition to a Moyno TM progressive cavity pump, a true mass flow meter device may be used to measure input independent of viscosity. The Moyno TM cavity pumps 36 can pump up to 30% total solids and have a fixed feed volume relative to RPM ratio, thereby enabling precise measurement of the material being transported. The typical solids content of a sludge entering the dryer will be about 15–30%. The cavity pumps 36 pump sludge from the holding tank 34 through pipe 38, preferably having a diameter from between 4" to 8", to a distribution cone 42. The distribution cone 42 is shown in section in FIG. 3. Material in the pipe 38 is divided into numerous (here shown as 10) equal sized input lines 46. The manner of connection of the input lines 46 to the top auger bed 22 is shown in FIGS. 4A, 4B and 4C. Each input line 46 is connected to the basal portion 48 of a respective auger flight 22. Each input line 46 is preferably made of a transparent flexible hose so that the material flowing into any auger flight 22 may be visually inspected. In this manner, as the spiral auger 52 rotates and sections of the auger move across the end of the input line 46, material extruded from the input lines 46 is sheared off and moved along the auger flight 22 by the spiral auger. Material should preferably be fed at a rate that fills the conveyors to about 50% volume.

Figure 5A:
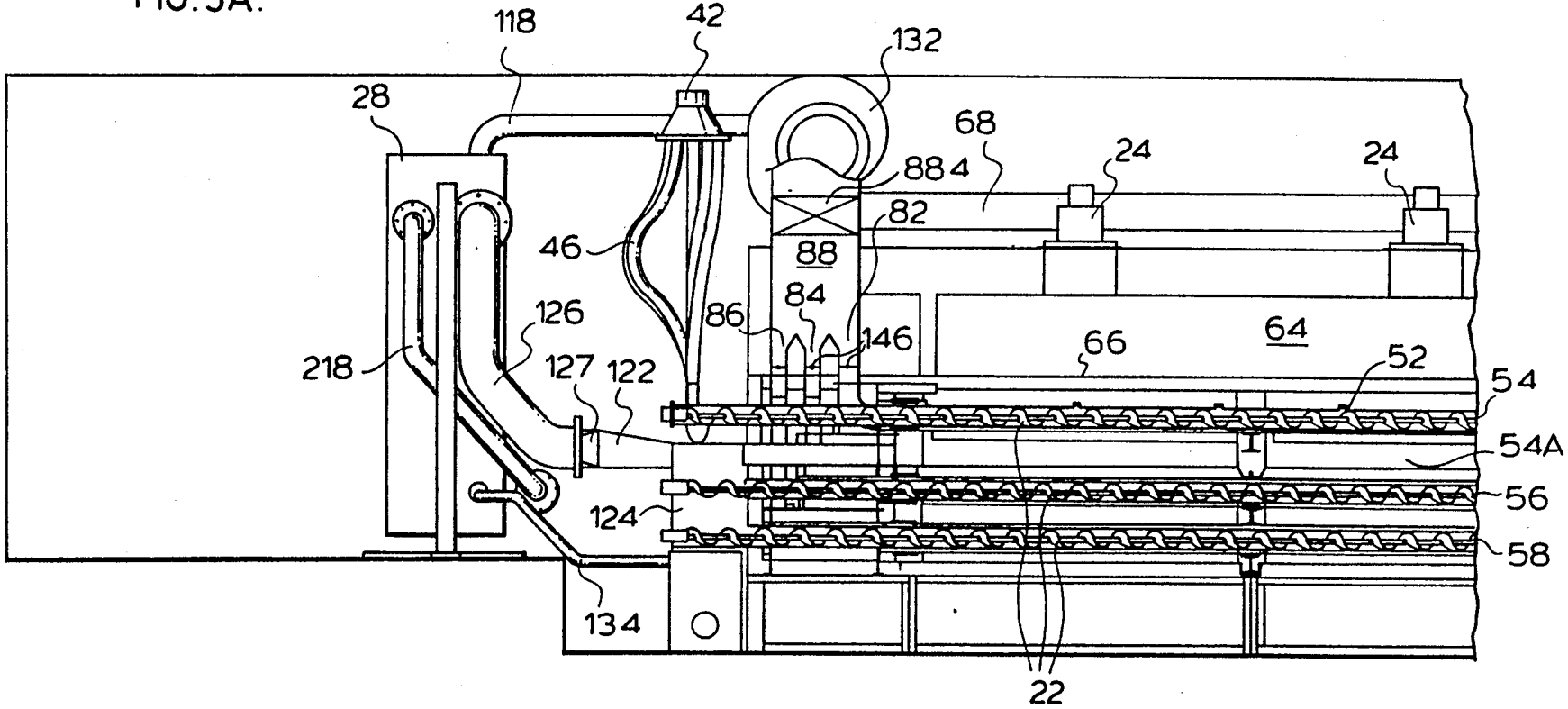
FIGS. 5A and 5B together show a schematic section of the radiant plate dryer module of FIGS. 1A and 1B.
Figure 5B:
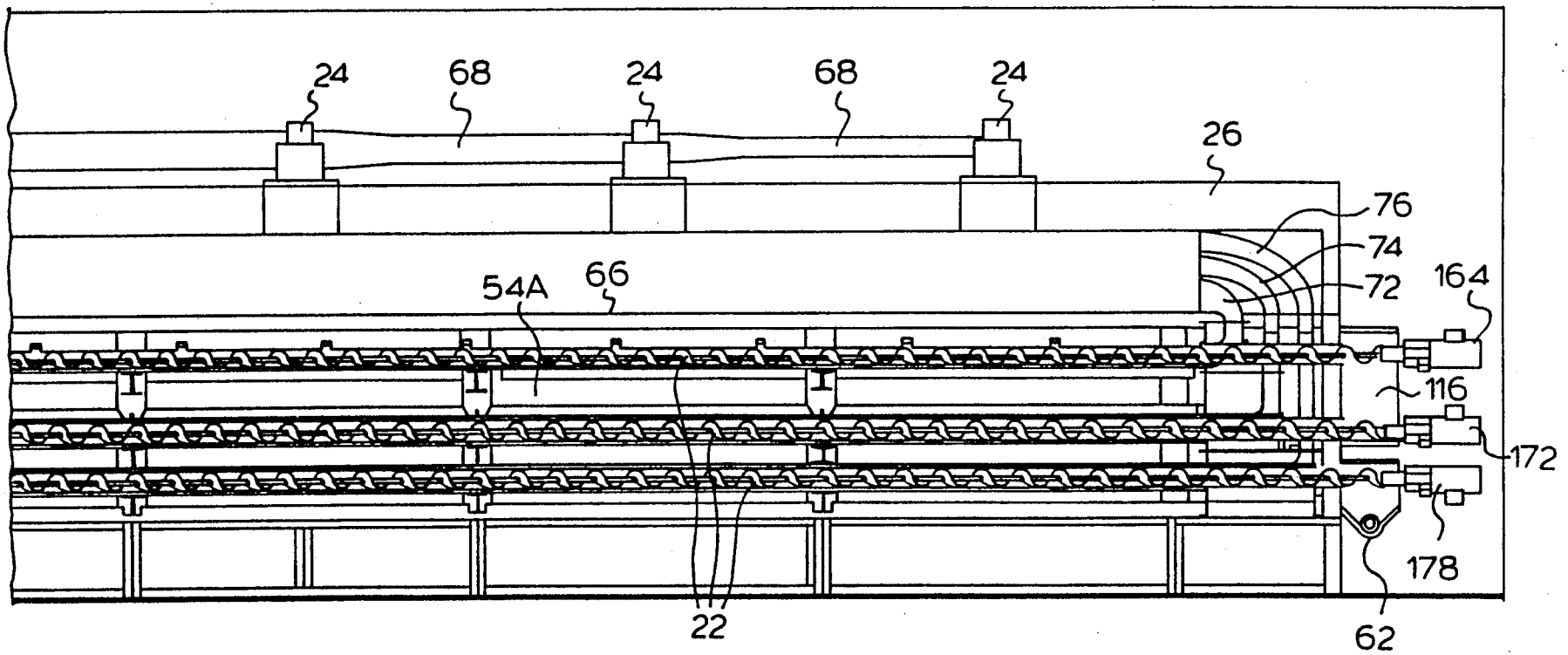
Figure 6A:
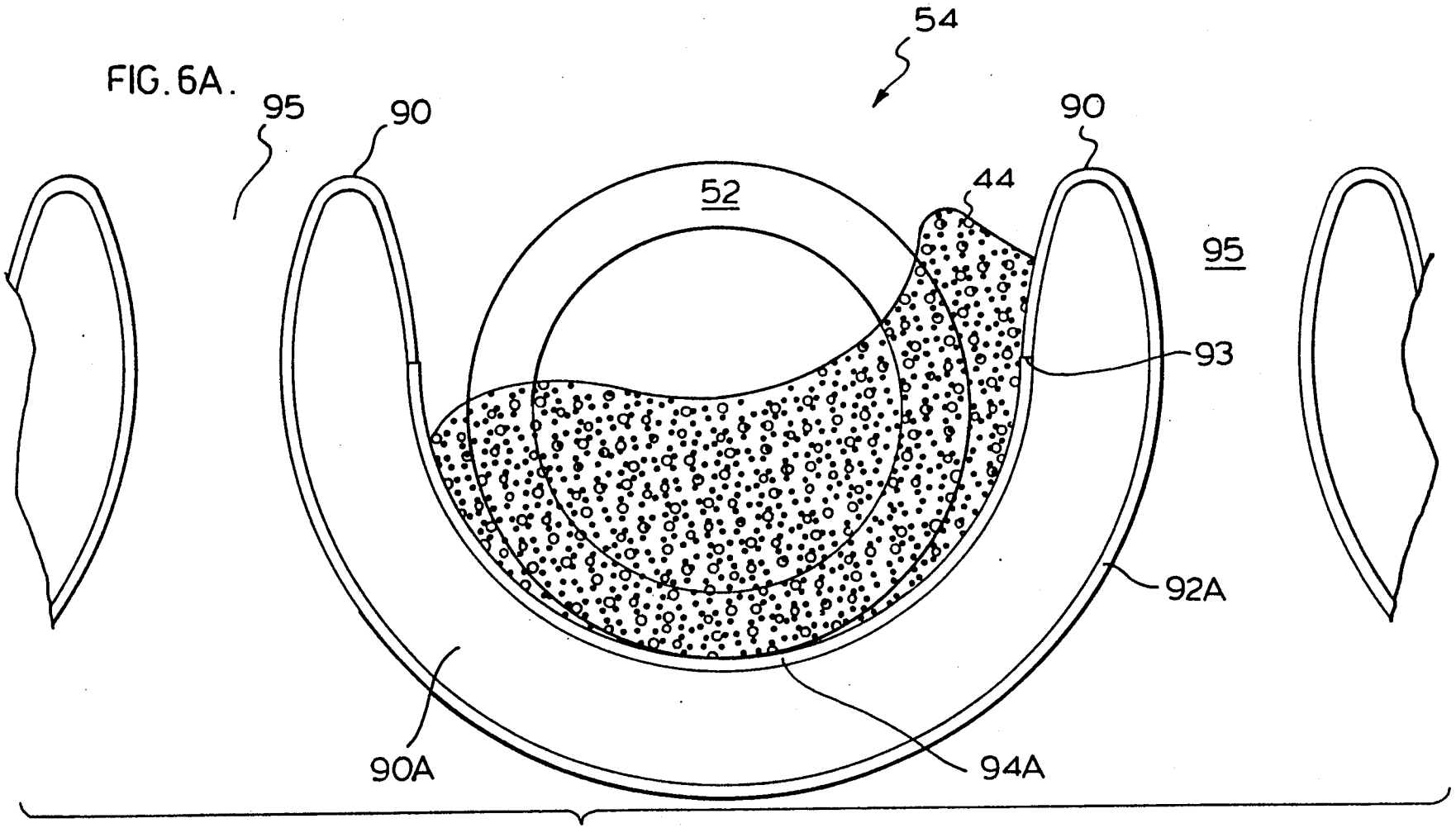
FIGS. 6A and 6B are sections through auger flights used in the upper and lower auger beds respectively of the radiant plate dryer module shown in FIGS. 1A and 1B.

Referring now to FIGS. 5A and 5B, the auger flights 22 are layered in banks and in the preferred embodiment have three banks, an upper first bank 54, a middle second bank 56 and a lower third bank 58. The augers and the material contained in them in the upper bank 54 are exposed to high intensity infrared flux from the radiant plate 66 which forms the base of the fire box 64 described in more detail below. The augers in the other two levels are enclosed. Each auger flight is formed from a double shelled tube to form a jacket as will be described in more detail below in relation to FIGS. 6A and 6B.

Material being processed is moved through the dryer module by rotation of the spiral augers 52, each driven by an individual, variable speed electric motor (motors 164, 172 and 178), each of which is readily commercially available. The spiral auger 52 rotates at speeds of from 60 to 5000 revolutions per minute depending on the throughput volume to be dried. Movement of the material being processed is ultimately from the input end 16 to the output end 18 of the module. The middle auger bank 56 moves the material in the opposite direction to the other two auger banks. Material is moved across the module on level 54, down to level 56 through box 116 (in which the material moves by gravity after exiting the augers in level 54), back across the module down to level 58 through box 124, and again across the module to the output end 18. Dried product is removed from the module by the discharge auger 62 at the end of the bottom auger bed 58.

The top auger bed 54 is open and material in the spiral augers 52 (FIG. 6A) is exposed to high intensity infrared flux from the radiant plate 66 which forms the base of a fire box 64. The radiant plate 66 is energized by two rows of five radial flame burners 24 located above the fire box 64. A number of commercial burners are available of the radial flame design. This type of burner is readily commercially available and therefore is only shown schematically here. Each of the radial flame burners 24 should preferably have variable output settings. These burners 24 have a characteristically flat flame that spreads out below the burners to give even heat to the radiant plate 66 that forms the high infrared radiant flux base plate for the firebox. While a firebox with ten radial flame burners has been described, different numbers of burners (for example 9 to 15) with different arrangements may be used, the object being to provide a constant, but variable energy gradient along the radiant plate 66. Air for the radial flame burners is supplied by line 68, and fuel (natural, gas, propane, butane, methane, diesel fuel, heating oil) by line 70.

The radiant plate 66 is formed into several plate segments lying adjacent to each other to form an essentially continuous high infrared flux energy surface about 30 to 40 centimetres below the burner nozzles. The radiant plates 66 are separated only by the amount required for the support mechanism and to accommodate thermal expansion. The support mechanism may be a cassette system in which the radiant plates are supported in a framework (element 149 in FIG. 9) composed of beams extending in a grid covering approximately 70% of the upper part of the dryer module 12 running the length of the dryer module.

Hot flue gas from the fire box 64 is passed through the hot flue gas distribution ducts 72, 74 and 76 respectively exiting from the fire box 64. Duct 72 feeds the upper auger bed 58, all as shown at the output end 18 of the dryer module 12. Preferably, distribution of hot flue gas is about 50% for the upper bed 54, about 30% for the middle bed 56 and about 20% for the lower bed 58. It is preferable that the upper bed 54 receive more flue gas heat energy than the middle level 56, and that the middle level 56 receive more flue gas heat energy than the lower level 58. For fixed installations, exhaust gas exiting the machine could be ducted through other heat exchangers for further use in other plant processing areas.

Figure 6B:
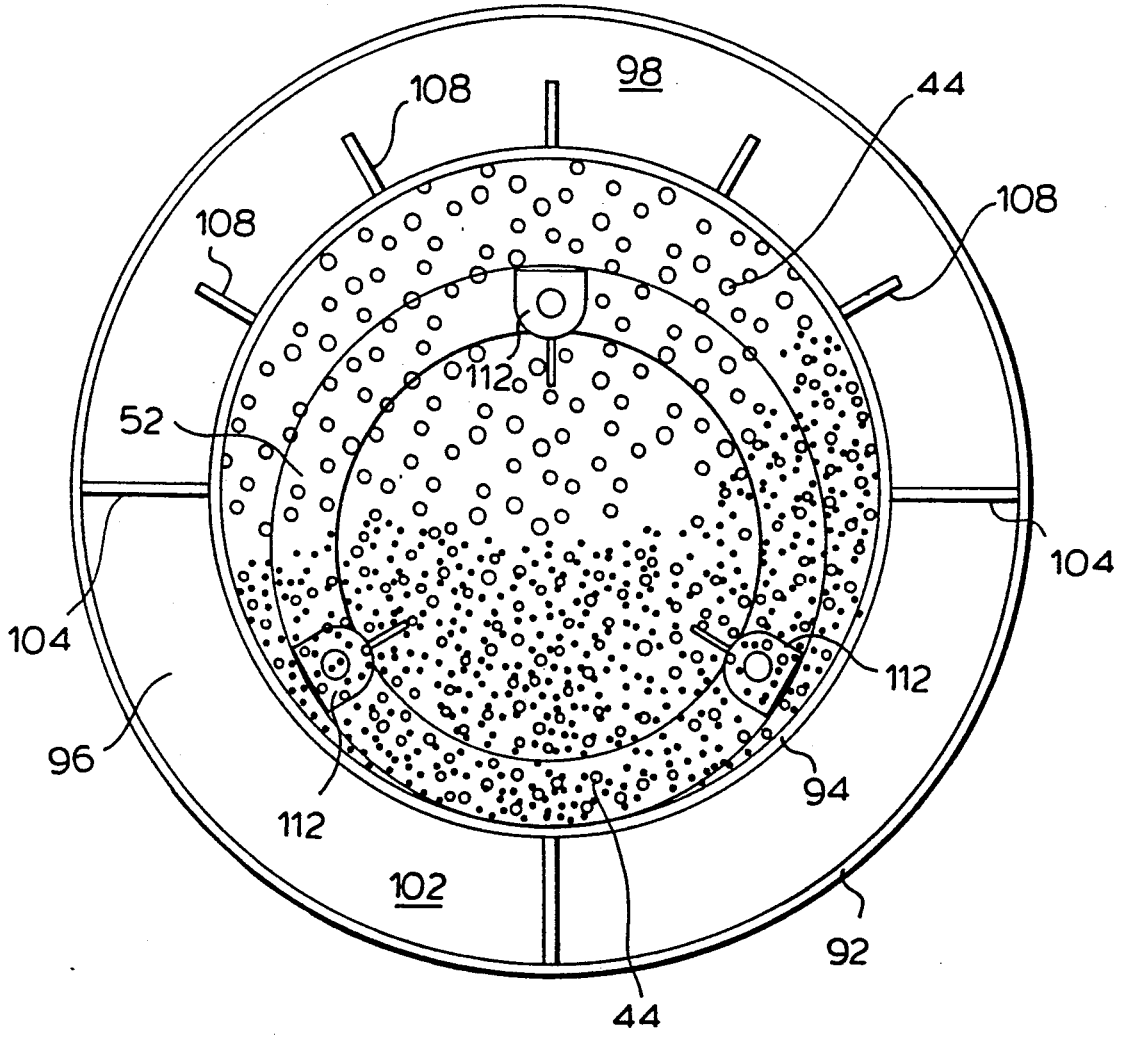
Figure 7:
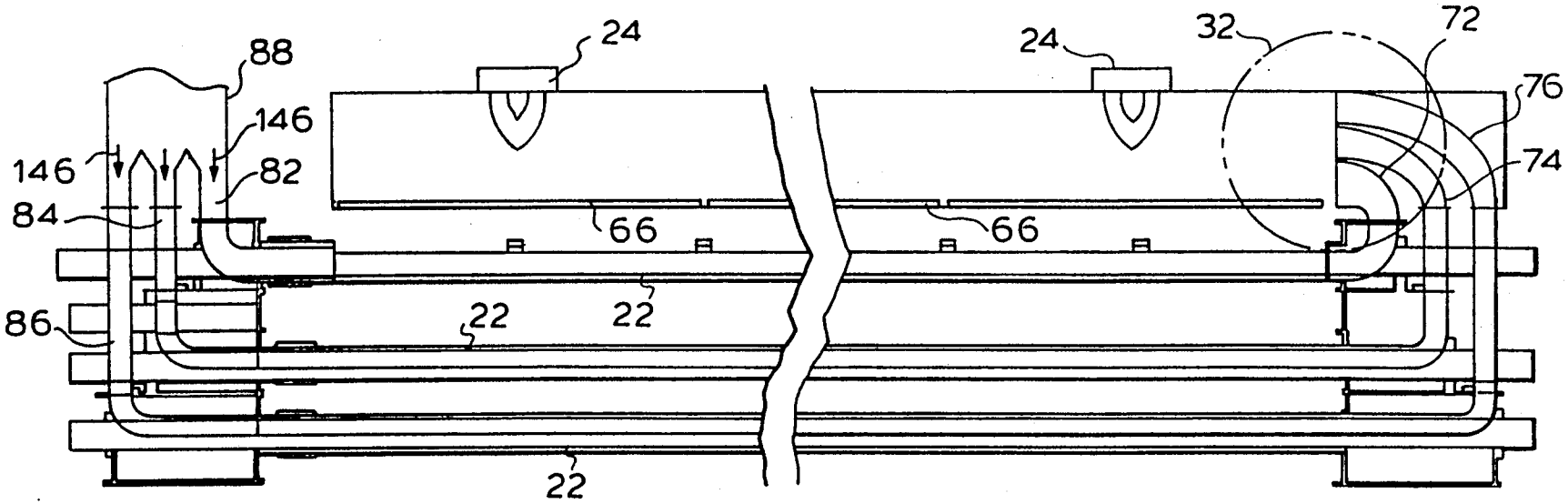
FIG. 7 is a schematic showing distribution of the hot flue gases to the jacketed auger flights.

Referring now to FIG. 6B, there is shown a section through an auger flight as used in either of the middle or lower auger beds 56, 58. Auger banks are formed from an outer tube 92 and an inner tube 94 running the length of each auger flight. A spiral auger 52 is provided within the inner tube 94. The spiral auger is a commercial product and is readily available in various diameters and pitches from a variety of sources. Specific augers would be chosen to best transport the material intended to be processed.

The annulus or jacket 96 defined by the outer tube 92 and the inner tube 94 is divided into an upper portion 98 and a lower portion 102 by baffles 104 on either side of the jacket 96. Several vanes or fins 108, here shown as five in number, extend radially from the inner tube 94 into the jacket air space 98. As described immediately below, hot flue gas passes through the upper section 98, heating vanes 108 which transfer energy by conduction to the inner shell 94 which also receives heat directly from the hot flue gas. By this means, the upper portion of the inner tube becomes very hot, radiating high intensity infrared flux which assists in drying the material being processed 44 in the banks 56, 58. Heat will also pass into the lower portion of the inner tube 94 by conduction and assist in heating the material from below. The temperature of the lowest point of the inner tube will be dramatically less than the highest point whenever material is present in the auger flight to act as a heat sink. This heating and drying system providing a combination of convective heat around the tube and a radiant heat surface in the upper portion facilitates heat transfer to the material being dried 44. The low temperatures in the bottom of the tube 96 prevent the material 44 from burning, and facilitates the dryer's processing of a variety of temperature sensitive products.

Paddles 112, each about 1 to 2.5 cm in length and attached to the spiral augers 52 stir the material and crush it to assist in exposing fresh moist material to the high intensity infrared flux radiating from the upper portion of the inner tube 94 and to convective energy through absorption by contact with the tube walls 94. The released steam will be super heated from exposure to the radiant and convective heat inside tube 94 and will reach a temperature of about 130° C. to 150° C. At this temperature, steam will contribute an additional drying effect on the sludge 44. The steam collection system has been designed to take advantage of the steam's drying capacity by evacuating it through auger tubes 94 in the middle and lower auger beds 56, 58.

FIG. 6A is a section through an auger flight 54 in the top auger bed. Auger flight 54 is formed from an outer tube 92A, which is bent to form curve 90, and an inner tube 94A, that has been cut and welded at seam 93 to form a trough through which the spiral auger rests and the material 44 flows, and an annulus or half jacket through which hot flue gases flow 90A. A spiral auger 52 moves the material under power from the electric motor 164 shown in FIG. 9. Bridge supports, not shown in FIG. 6B but shown in FIGS. 1B and 5A, support the walls of each auger flight 22 by connection to the upper portions 90. It will be appreciated that in this patent disclosure where an auger is exemplified, the other auger flights in the same level have essentially the same configuration.

Returning now to FIGS. 5A, 5B and 7, hot flue gas passes through the top auger bed 54 by being ducted through the half jacket 90A (FIG. 6A) of each flight in auger bed 54 towards chimney ducts 82 connected to the jackets. There are 10 auger flights in the top auger bed 54 connected to a chimney duct 82, and likewise for the ducts described below. Hot flue gas supplied to the middle auger bed 56 flows through the upper portion to the jacket (FIG. 6B) of each auger flight towards chimney duct 84. Hot flue gas supplied to the bottom auger bed 58 flows through the upper portion of the jacket 98 (FIG. 6B) of each auger flight towards chimney duct 86. The ducts 82, 84 and 86 lead into the main chimney 88 to which is attached a fan 88A for evacuating the flue gas within the flue gas distribution and duct system.

The chimney ducts 82, 84 and 86 are provided with flaps 146 that can be controlled and preferably electrically actuated by motors not shown, so that the hot flue gas flow in each of the ducts 82, 84 and 86, and consequently within the jackets of the auger flights 22 of each auger bed 54, 56 and 58, can be selected from anywhere between full discharge and the closed position. This is particularly advantageous at start up since heated flue gas can be selected for delivery only where there is sludge so as to reduce thermal load and shock to dryer components thus avoiding heating auger flights when sludge is not present.

The radial flame burners 24 are also preferably independently operable with a variable output range so that at start up they will be operated sequentially in intervals of about 1 minute. Thermal shock may be reduced by turning a burner on only when there is or is about to be damp material beneath it. It is believed, this will substantially add to the dryer'sd useful operating life span. The reverse procedure (shut off the burners as the last material passes underneath the burner) may also be used to reduce heat shock on dryer shut down.

Figure 8:
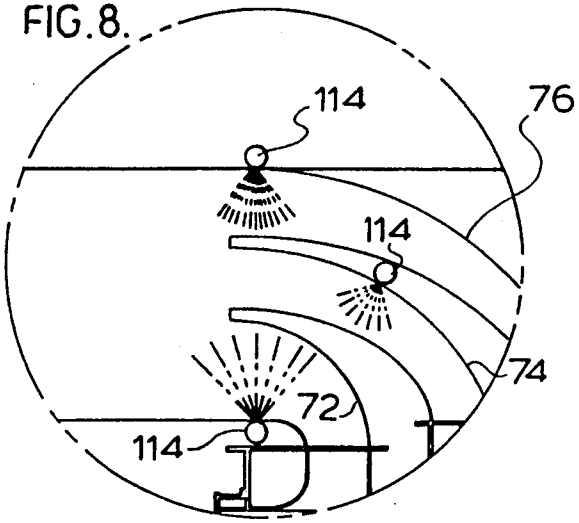
FIG. 8 is a blow up of the flue gas distribution section of the fire box with the flue gas water spray cooling system identified, and as shown schematically in FIG. 7.

Referring now to FIG. 8, the inlet portions of the hot flue gas ducts 72, 74 and 76 upstream of the auger beds 54, 56, 58 are provided with water injection means through nozzles 114. When used as a dryer for grain or any other temperature sensitive material, water can be easily sprayed into ducts 72, 74 and 76 to control the heat delivered to the auger flight jackets. The nozzles 114 should be placed close to the fire box 64 since the temperature of the flue gas must be reduced quickly, there being only a short distance between the fire box exit and auger beds. Preferably there are several nozzles, for example 5 to 10, in each duct, each operating at about 20 psi to about 300 psi. Each nozzle 114 is supplied by a high pressure water pump with a bypass control (not shown) to keep the water flowing past the nozzle to provide nozzle cooling except where required. Spray nozzles which will produce a particle size under 200 microns will be required to assure transformation of water to steam before entering the auger flight heat exchanger jackets. The water may be supplied from condensate produced by the condenser 28.

The drying process causes steam and other volatile gases for form above the material being dried 44. The steam is collected from auger bed 54 through steam inlet ducts 95, which lead from auger bed 54 between the individual auger flights into the steam collection chamber 54A located between auger bed 54 and 56 as shown on FIGS. 5 and 6A. From the chamber 54A, steam is drawn into the steam collection box 124 and processed through the condenser as described herein. Steam is evacuated from the inner tube 94 (FIG. 6B) of each auger flight in auger beds 56 and 58 (FIG. 5A) through the steam collection box 124 and into steam ducts 122 and 126 via one-way valve 127 to the condenser 28. The steam will be contaminated by any other gases released by the material being dried. In the condenser 28 (readily commercially available), the steam is collapsed and condensed out and the resultant hot water removed through the line 134 and pump 135. The remaining vent gases which may be noxious and odour containing are sucked out of the condenser by a vacuum pump (now shown) and are ducted back into the burner system through line 118 and fan 132. For fixed installations, steam may be drawn off at the condenser for use in other plant processing functions, or directed through heat exchangers to provide heat wherever required.

The dryer module's components described above are preferably made of stainless steel.

Figure 9A:
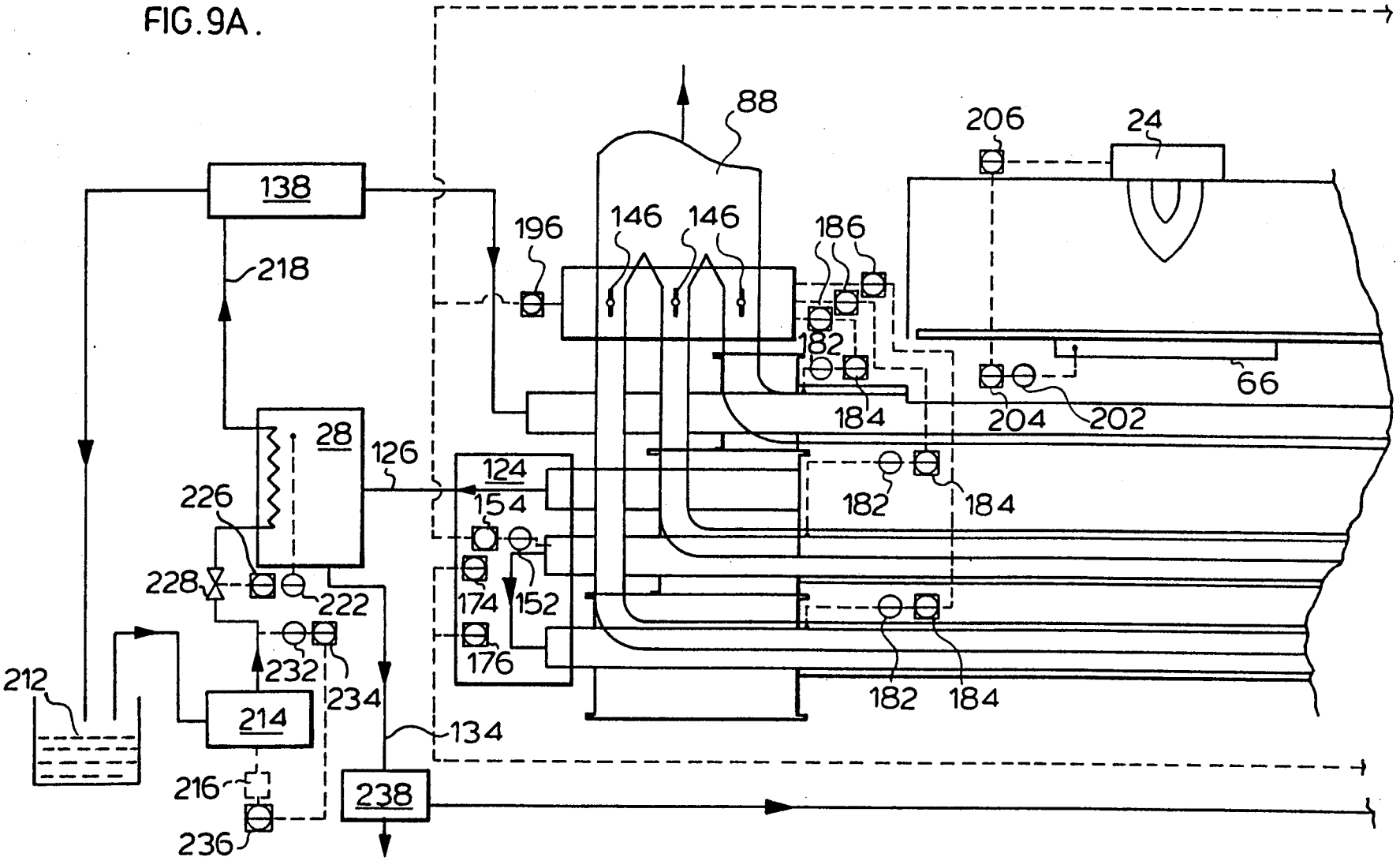
FIGS. 9A and 9B schematics showing the process control of the present invention.
Figure 9B:
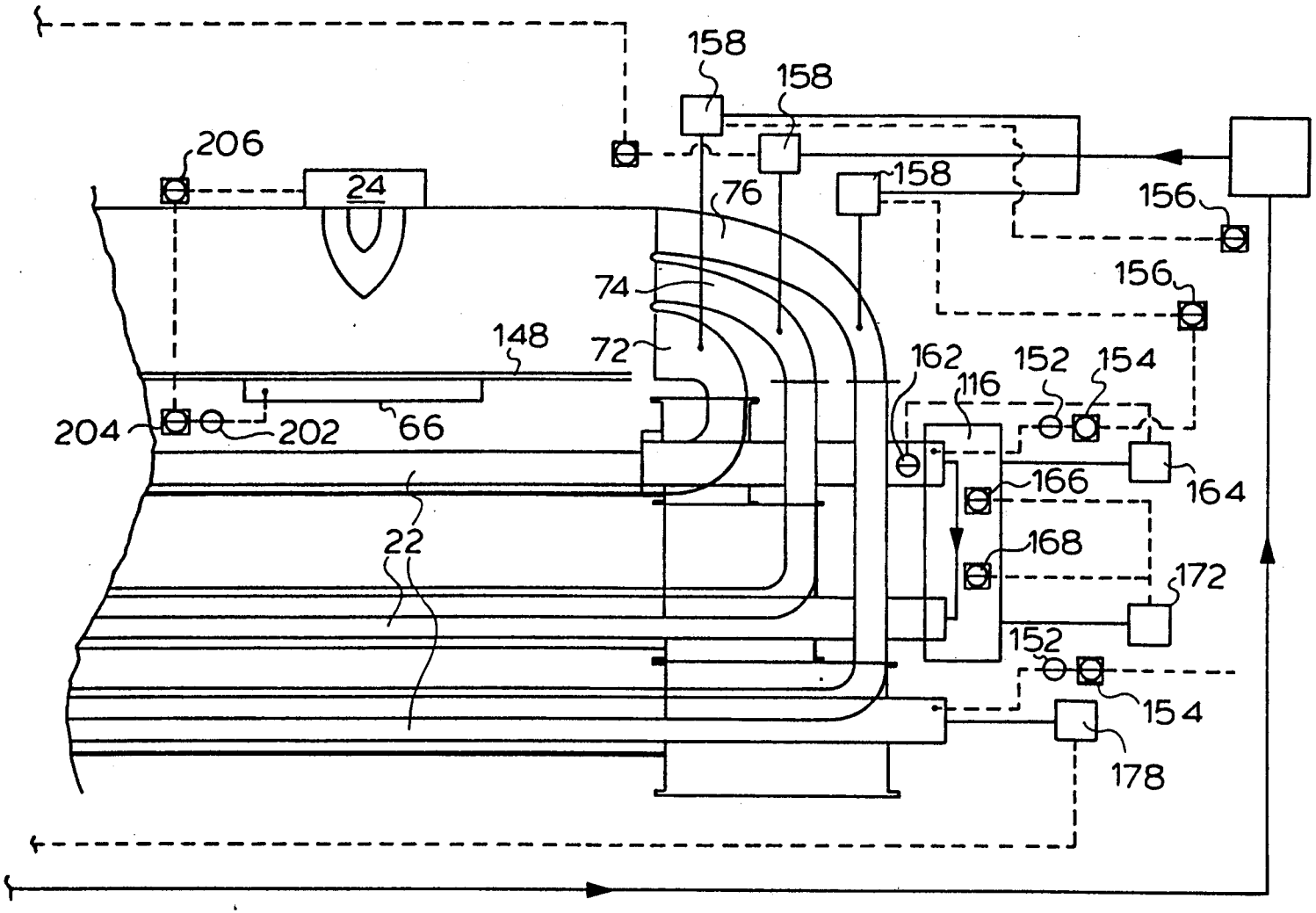

Referring now to FIGS. 9A, and 9B the present invention contains several control systems, namely the control of flue gas temperature, the control of the flue gas flow rate, the control of the input material flow rate, the control of the burners and the control of the condenser. The flue gas temperature is controlled by means of a system including temperature elements 152, temperature indicators 154 and controllers 156. The elements 152 sense the temperature of the material in various auger beds 22 and the temperature indicators 154 read this temperature and pass signals indicative of the temperature controllers 156. Temperature of the material being processed is preferably kept below 130 degrees C.

If the temperature increases above this range or any other value deemed critical to the material being processed, then water may be injected into the flue ducts 72, 74 and 76 (via nozzles 114) using pumps 158 to reduce the temperature of the hot flue gases that are circulated through the auger flight jackets 90A, 98. If the temperature of the material falls below the specified value, less water will be injected into the flue ducts 72, 74 and 76. When flue gas temperatures reach 900 degrees C. or greater, which will occur during normal high temperature operations, the flue gas temperature will require continuous cooling and input of water whenever it is desirable for the purposes of recycling, to avoid burning the dried end product. Water is supplied to the pumps through line 134, which is attached to the condenser 28. The sensors 152 are preferably plats temperature sensors with the material being processed passing over the sensing plate so that the actual temperature of the material being processed is measured.

Wet material is input to the dryer into the first auger bed 54 through the progressive displacement cavity pump 36 from holding tank 34 through line 38 and distribution cone 42, which together are shown as the input 138 in FIG. 9. The material level in the first auger bed is measured by level indicator 162, which like the other level indicators described here is preferably a commercially available nuclear radiation level indicator. If the level becomes too high, the motor 164 increases the spiral augers' speed to move the material more quickly. Similarly, the material level in the box 116 is monitored by high level indicator 166 and low level indicator 168. Depending on the material level, the speed of the second auger bank may be changed by motor 172 to increase the speed of the spiral augers (material too high) or decrease it (material too low). The material in the box 124 is monitored by high level indicator 174 and low level indicator 176, and the speed of the lower auger bank is modified in like fashion by motor 178.

Flue gas is controlled through temperature elements 182, temperature indicators 184 and controllers 186. It is believed that approximate temperature equalization of the exhausting flue gases is desirable to achieve the best thermal efficiency. The flue gas temperature at the ends of the auger banks (at the chimney inlet) is sensed by elements 182, and a signal indicative of the temperature is sent by the temperature indicators 184 to controllers 186. If the temperature in an auger bank is too high or too low, then the corresponding duct 82, 84 or 86 can be closed or opened (respectively) to lower or increase the flue gas flow rate. The temperature of the material in the box 124 may also be monitored by temperature element 152, which preferably extends into the material stream. The temperature signal is sent by the indicator 154 to controller 196, which can modify the position of all of the flaps 146. If the material's temperature is too high, then the flaps 146 may be closed somewhat to reduce the amount of hot flue gas passing through the auger flight jackets and vice versa.

The temperature of radiant heat plate 66 is controlled as follows. Temperature elements 202 detect the heat and signals indicating plate temperature are sent by the indicators 204 (connected to the sensors as shown) to the controllers 206. The fire box temperature may be modified by controlling the radial flame burner output settings to produce the desired plate temperature. Burner management systems are commercially available and the feedback loops will not be further described here. Each radiant plate is sensored. While one plate has been shown for each burner in FIG. 9A and 9B, there may be different numbers of plates for each burner.

The condenser 28 is commercially supplied and several commercial control systems are also available. Therefore, specific details will not be provided here except for the following operation summary. Glycol is stored in overflow tank 212 and pumped through the condenser 28. A heat sink 214, preferably air cooled, cools the glycol. The glycol, as previously described, is also circulated through line 218 from the condenser 28 to the storage tank 34 in the input system shown at 138. For fixed installations, the glycol could be circulated to capture excess heat, eliminating the air cooler, through other plant heat exchangers deemed useful for the specific processing operation. The condenser 28 is fluidly attached to the dryer module 12 though line 126. Pressure inside the condenser 28 is monitored by pressure transmitter 222 which in turn is connected to controller 226. Controller 226 controls valve 228 by regulating the glycol flow through the condenser which in turn regulates the rate of steam condensation. By controlling the glycol flow rate through the condenser 28, and hence the rate of steam collapse, the amount of suction generated by the condenser and therefore the rate of steam withdrawal out of the dryer module 12, may be controlled. The pressure in the dryer module 12 should always be maintained slightly negative.

The temperature control of the glycol leaving the heat sink 214 is monitored with sensor 232 connected to indicator 234 and controller 236. Controller 236 controls the cooling effect of the air cooler (i.e. heat sink 214) to maintain a prescribed glycol temperature measured by sensor 232. A relief valve (not shown) should be provided in the condenser 28 to release accidental excess negative or positive pressure.

The moisture evaporation rate may be monitored from knowing the input moisture content (determined for example using a hand held device) and measuring the rate of water draining from the condenser through flow meter 238 on line 134. Calibrating this measurement with the feeder input control 138 provides a means to self regulate the end product's moisture content.

The dryer module thus described for mobile processing could be mounted on a conventional trailer 14 with wheels and front supports 13 (one shown). The storage or holding tank 34 is preferably skid mounted, and the dryer is preferably supplied in operation with a mobile control station, for example a converted motor home. In fixed installations, remote control operation by plant staff would be facilitated by integrating the dryer module's control system with the plant's control system to accommodate full system operation and monitoring from a remote computer console in the plant's control room. During mobile processing, sludge would be pumped from a lagoon into the holding tank 34, which would hold about a 12 hour supply. In a fixed installation, material input feed into the dryer module would be custom designed. Dried sludge would be discharged by the spiral auger to discharge 62 to a commercially available storage bin (not shown) that will need to be emptied at a frequency that depends on its volume. Power supply (150 kilowatts of 220 volt three phase power) may be from the local power grid or from a standard diesel generator. The radial flame burners described may use as a fuel supply heating oil, natural gas, methane, butane, propane and diesel, although natural gas is preferred. A fuel tank will of course be required where there is no continuous supply of fuel.

A person skilled in the art could make immaterial modifications to the invention described and claimed herein without departing from the essence of the invention.

Embodiments of the invention in which an exclusive property of privilege is claimed are defined as follows:

1. A dryer comprising:

a dryer module having an input end for receiving wet material containing solids and an output end for discharging dried solid materials;

one or more auger banks disposed within the dryer module between said input end and said output end, each auger bank being made up of a number of auger flights, each flight including a rotatable spiral auger for continuously conveying said material within the auger flight;

a heat source for providing radiant heat to at least one of said one or more auger banks so as to heat and thereby dry said material, the heat source also providing a source of flue gases;

flue gas distribution means for providing flue gas from the heat source to at least one of said auger banks for further heating and thereby drying of said material; and water injection means having an outlet in the flue gas distribution means up stream of the auger banks.

2. The dryer of claim 1 further including a condenser in fluid connection with each auger bank.

3. The dryer of claim 1 further including a holding tank for said wet material, said holding tank being connected to said input end of the dryer module.

4. The dryer of claim 1 wherein said input end of the dryer module further includes a pump in fluid connection with the auger banks for providing continuous distribution of wet material containing solids to each auger flight.

5. A dryer comprising:

a dryer module having an input end for receiving wet material containing solids and an output end for discharging dried solid materials;

at least two auger banks disposed within the dryer module between said input end and said output end, the auger banks being arranged in layers, each auger bank being made up of a number of auger flights, each flight including a rotatable spiral auger for continuously conveying said material within the auger flight;

a heat source for providing radiant heat to at least one of said one or more auger banks so as to heat and thereby dry said material, the heat source also providing a source of flue gases; and flue gas distribution means for providing flue gas from the heat source to at least one of said auger banks for further heating and thereby drying of said material; and means for distributing flue gas differentially to each layer of auger banks.

6. A dryer comprising:

a dryer module having an input end for receiving wet material containing solids and an output end for discharging dried solid materials;

one or more auger banks disposed within the dryer module between said input end and said output end, each auger bank being made up of a number of auger flights, each flight including a rotatable spiral auger for continuously conveying said material within the auger flight;

a heat source for providing radiant heat to at least one of said one or more auger banks so as to heat and thereby dry said material, the heat source also providing a source of flue gases; and flue gas distribution means for providing flue gas from the heat source to at least one of said auger banks for further heating and thereby drying of said material;

the auger banks being layered and including a first bank, a second bank and a third bank and the means for distributing flue gases differentially to the auger banks providing about 50% to the first bank, about 30% to the second bank and about 20% to the third bank.

7. A dryer comprising:

a dryer module having an input end for receiving wet material containing solids and an output end for discharging dried solid materials;

one or more auger banks disposed within the dryer module between said input end and said output end, each auger bank being made up of a number of auger flights, each flight including a rotatable spiral auger for continuously conveying said material within the auger flight;

a heat source for providing radiant heat to at least one of said one or more auger banks so as to heat and thereby dry said material, the heat source also providing a source of flue gases; and flue gas distribution means for providing flue gas from the heat source to at least one of said auger banks for further heating and thereby drying of said material;

the auger banks being layered and including at least an upper auger bank and a lower auger bank of auger flights, each auger flight in the lower auger bank comprising:

an outer tube;

an inner tube disposed within the outer tube to form a jacket between them;

a spiral auger disposed within the inner tube; the jacket having an upper portion and a lower portion, the upper portion and the lower portion being separated from each other;

the upper portion being in fluid connection with the flue gas distribution means; and the lower portion being isolated from the flue gas distribution means.

8. The dryer module of claim 5 in which the auger banks are layered and include at least an upper auger bank and a lower auger bank of auger flights, each auger flight in the lower auger bank comprising:

an outer tube;

an inner tube disposed within the outer tube to form a jacket between them;

a spiral auger disposed within the inner tube; the jacket having an upper portion and a lower portion, the upper portion and the lower portion being separated from each other;

the upper portion being in fluid connection with the flue gas distribution means; and the lower portion being isolated from the flue gas distribution means.

9. The dryer module of claim 6 in which the auger banks are layered and include at least an upper auger bank and a lower auger bank of auger flights, each auger flight in the lower auger bank comprising:

an outer tube;

an inner tube disposed within the outer tube to form a jacket between them;

a spiral auger disposed within the inner tube; the jacket having an upper portion and a lower portion, the upper portion and the lower portion being separated from each other;

the upper portion being in fluid connection with the flue gas distribution means; and the lower portion being isolated from the flue gas distribution means.

10. The dryer of claim 7 in which the spiral auger includes a number of paddles extending outward from the spiral auger.

11. The dryer of claim 7 in which the inner tube has an upper half and the upper half includes a number of vanes extending radially outward into the jacket.

12. The dryer of claim 7 further including means connected to the inner tubes of the auger flights for circulating dry steam away from the auger flights.

13. A method of drying industrial sludges or industrial organic and inorganic slurries comprising:

storing a volume of wet material adjacent to a dryer module in a holding tank;

providing a continuous flow of material from the holding tank to auger flights disposed within the dryer module;

heating the material by radiant heat source, the radiant heat source being disposed across a length of the dryer module;

moving the material continuously through the dryer module;

drying the material to sufficient dryness to accommodate safe storage or disposal;

removing the dried material from the dryer module; and providing initially greater heat to a first portion of the radiant heat source such that a first portion of the auger flights have greater heat exposure than a second portion of the auger flights.

14. The method of claim 13 wherein the material is dried to about 60%-75% solids content by weight.

15. A method of drying industrial sludges or industrial organic and inorganic slurries comprising:

storing a volume of wet material adjacent to a dryer module in a holding tank;

providing a continuous flow of material from the holding tank to auger flights disposed within the dryer module, the auger flights being layered with at least a first and second bank of auger flights;

differentially supplying flue gas through flue gas distribution means to the auger banks such that different volumes of flue gases can be supplied to the first and second auger banks;

heating the material by radiant heat source, the radiant heat source being disposed across a length of the dryer module;

moving the material continuously through the dryer module;

drying the material to sufficient dryness to accommodate safe storage or disposal; and removing the dried material from the dryer module.

16. The method of claim 15 in which the first auger bank is an upper level and the second auger bank is a lower level and the flue gas distribution means supplies more flue gas to the first level than to the second level.

17. A method of drying industrial sludges or industrial organic and inorganic slurries comprising:

storing a volume of wet material adjacent to a dryer module in a holding tank;

providing a continuous flow of material from the holding tank to auger flights disposed within the dryer module;

providing flue gases to auger flight jackets through flue gas distribution means in fluid connection with each auger flight jacket and water spray cooling injection into the flue gas distribution means to selectively cool the flue gases before being directed to the auger flight jackets;

heating the material by radiant heat source, the radiant heat source being disposed across a length of the dryer module;

moving the material continuously through the dryer module;

drying the material to sufficient dryness to accommodate safe storage or disposal; and removing the dried material from the dryer module.

18. The method of claim 13 further comprising circulating steam from the wet material through the auger flights to a condenser.

19. An auger flight for a dryer, the dryer having a number of auger banks, a heat source and means for providing flue gas from the heat source to the auger banks, the auger flight comprising:

an outer tube;

an inner tube disposed within the outer tube to form a jacket between them;

a spiral auger disposed within the inner tube; the jacket having an upper portion and a lower portion, the upper portion being separated from the lower portion;

the upper portion being connectable with the flue gas distribution means; and the lower portion being isolated from the hot flue gas distribution means.

20. The auger flight of claim 19 in which the inner tube includes a number of vanes extending into the jacket radially outward towards the outer tube on the upper portion of the tube, such that the upper portion of the inner tube extracts heat energy from the flue gases passing through the jacket, and becomes a radiant heat source exposing the material disposed in the spiral augers of the inner tube to radiant heat.

21. The spiral auger of claim 19 further including several paddles attached to the spiral augers to crush and break down the material in the spiral augers.

22. The spiral auger of claim 19 in which the lower portion of the jacket is divided into two closed parts.

23. The spiral auger of claim 19 in which the upper portion and the lower portion of the jacket are each of about equal size.

* * * * *